US011105277B1

(12) United States Patent
Dudar

(10) Patent No.: US 11,105,277 B1
(45) Date of Patent: Aug. 31, 2021

(54) METHOD AND SYSTEM FOR VARIABLE DISPLACEMENT ENGINE WITH AC POWER GENERATION

(71) Applicant: Ford Global Technologies, LLC, Dearborn, MI (US)

(72) Inventor: Aed Dudar, Canton, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 0 days.

(21) Appl. No.: 17/158,996

(22) Filed: Jan. 26, 2021

(51) Int. Cl.

| | |
|---|---|
| ***F02D 17/02*** | (2006.01) |
| ***F02D 29/02*** | (2006.01) |
| ***F01L 1/34*** | (2006.01) |
| ***F02P 5/145*** | (2006.01) |
| ***F02D 29/06*** | (2006.01) |

(52) U.S. Cl.
CPC ..... *F02D 17/02* (2013.01); *F01L 1/34* (2013.01); *F02D 29/02* (2013.01); *F02D 29/06* (2013.01); *F02P 5/145* (2013.01)

(58) Field of Classification Search
CPC ..... F02D 17/02; F02D 29/06; F02D 29/02; F02P 5/145; F01L 1/34
See application file for complete search history.

(56) References Cited

U.S. PATENT DOCUMENTS 6,408,625 B1 * 6/2002 Woon ..... F02D 41/0007 60/608
6,487,998 B1 * 12/2002 Masberg ..... F02D 41/1497 123/192.1
7,629,719 B2 12/2009 Hamada
10,480,477 B2 * 11/2019 Sangameswaran ..... F02N 11/0825
10,737,583 B2 8/2020 Johnsen et al.
2011/0130902 A1 * 6/2011 Heisel ..... B60W 10/08 701/22
2017/0254279 A1 * 9/2017 Naidu ..... F02B 75/04
2019/0107062 A1 * 4/2019 Koenen ..... F02D 41/0087
2019/0323439 A1 * 10/2019 Attia ..... H02J 3/40

OTHER PUBLICATIONS

Bragman, A., 5 Fun Facts About the 2021 F-150's Onboard Generator, Pickup Trucks Website, Available Online at https://news.pickuptrucks.com/2020/06/5-fun-facts-about-the-2021-f-150s-onboard-generator.html, Jun. 25, 2020, 5 pages.

* cited by examiner

*Primary Examiner* — Carl C Staubach
(74) *Attorney, Agent, or Firm* — Geoffrey Brumbaugh; McCoy Russell LLP

(57) ABSTRACT

Methods and systems are provided for controlling a variable displacement engine (VDE) of a vehicle to adjust a power generated by the VDE based on a demand for power from an onboard AC power generator of the vehicle. In one example, a method for a vehicle includes, with an engine of the vehicle turned off, estimating a power draw of an external electrical device to be supplied power via an onboard generator of the vehicle, and starting the engine in a variable displacement engine (VDE) mode with a number of deactivated cylinders selected based on the estimated power draw.

20 Claims, 5 Drawing Sheets

METHOD AND SYSTEM FOR VARIABLE DISPLACEMENT ENGINE WITH AC POWER GENERATION

FIELD

The present description relates generally to methods and systems for controlling a variable displacement engine of a vehicle, and more specifically, to selectively deactivating cylinders of the engine in response to a demand for power from an onboard generator of the vehicle.

BACKGROUND/SUMMARY

To meet an increased consumer demand for portable power generation, vehicles may include an onboard generator powered by an internal combustion engine of the vehicle that provides alternating current (AC) power via a power outlet. In some examples the onboard generator may operate when the vehicle is stationary (e.g., parked), while in other examples the onboard generator may operate when the vehicle is moving. When activated in a stationary mode, a transmission of the vehicle may be locked so that the vehicle does not move while electrical loads are connected to the onboard generator. When the onboard generator is activated, the engine is operated to generate AC power.

Having all cylinders of the engine combust for low power loads may be inefficient, may degrade a fuel economy of the vehicle, and/or may increase emissions. When the engine is a variable displacement engine (VDE), one approach to increasing an efficiency of the engine includes deactivating one or more cylinders of the VDE after an engine start in response to a power draw of an external electrical device, as shown by Koenen et al in U.S. Patent Application Publication No. 2019/0107062. VDEs may be configured to operate with a variable number of active or deactivated cylinders to increase fuel economy, while optionally maintaining the overall exhaust mixture air-fuel ratio about stoichiometry. This may be referred to as operating in a VDE mode. Typically, a control system selectively deactivates cylinders via adjustment of a plurality of cylinder valve deactivators, thereby sealing the deactivated cylinders by maintaining intake and exhaust valves of the deactivated cylinders closed, and the deactivated cylinders are not fueled.

However, the inventors herein have recognized potential issues with such approaches. As one example, the engine of Koenen is operated with all cylinders active until the power draw of the external device is determined. As a result of activating all cylinders of the engine when the engine is started and subsequently deactivating one or more cylinders, the engine may be operated for a period of time with more torque than necessary to power the electrical device, and thus an efficiency of the engine may be reduced and an amount of emissions increased. Up to 80% of hydrocarbon tailpipe emissions during a drive cycle occur during a cold start, as the cylinders may be operated rich to increase the temperature of the exhaust gas and aftertreatment devices may not yet be at light-off temperature. Thus, the inventors herein have recognized that unnecessary engine operation at higher than necessary torque during and immediately following an engine start may increase emissions and waste fuel.

In one example, the issue described above may be addressed by a method for a controller of a vehicle, comprising, with an engine of the vehicle turned off, estimating a power draw of an external electrical device to be supplied power via an onboard generator of the vehicle, and starting the engine in a variable displacement engine (VDE) mode with a number of deactivated cylinders selected based on the estimated power draw. In this way, the engine may be started with a number of cylinders activated that is estimated to generate sufficient torque to supply power to the electrical device that covers the estimated power draw, without activating additional cylinders, thereby reducing emissions and fuel consumption during the engine start.

As one example, a driver of the vehicle may wish to power an electrical device via the onboard generator when the vehicle is not in operation. The driver may plug the electrical device into a power outlet of the vehicle coupled to the onboard generator. Upon plugging in the device, a controller of the vehicle may receive power data of the device (e.g., via Bluetooth®, an RFID tag, etc.). The controller may estimate a power draw of the device based on the power data, and switch the engine on with a number of engine cylinders activated (e.g., less than all cylinders of the engine activated) to cover the estimated power draw of the device, without generating excess power (e.g., that would be not be used by the device). For example, if the estimated power draw of the device is lower (e.g., charging a cell phone), the engine may be started with one or a small number of engine cylinders activated. If the estimated power draw of the device is higher (e.g., powering a construction tool), the engine may be started with most or all of the engine cylinders activated. By activating a number of engine cylinders to produce a torque that is sufficient to cover the estimated power draw, without activating additional engine cylinders, an emissions of the vehicle may be reduced and an efficiency of the engine may be increased. An additional advantage of the method is that if the electrical device is not a smart device, the power data of the electrical device may be alternatively inputted to the controller by presenting a bar code or quick response (QR) code of the device to a rear camera of the vehicle, or the controller may predict the estimated power draw from previous use of the onboard generator based on historical data. Another advantage is that a number of available usage hours of the electrical device may be estimated and notified to the driver.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

DETAILED DESCRIPTION

The following description relates to systems and methods for increasing an efficiency of an onboard generator of alternating current (AC) power of a vehicle powered by a variable displacement engine (VDE), by estimating a power draw of an electrical device plugged into the onboard generator and activating a number of cylinders of the VDE that is minimally sufficient to cover the power draw. For the purposes of this disclosure, a number of cylinders of the VDE that is minimally sufficient to cover the power draw is a number of cylinders of the VDE that, when active and fueled, generate a torque that provides sufficient power to the onboard generator to cover the power draw, where a lesser number of active and fueled cylinders would not cover the power draw.

It should be appreciated that while the onboard generator (also referred to herein as the generator) may be used by a driver of the vehicle, the generator may also be used by a person who is not the driver of the vehicle who has access to a power outlet of the vehicle. For example, the generator may be used by a passenger of the vehicle, or by a friend of the driver, etc. Therefore, for the purposes of this disclosure and with respect to a use of the onboard generator when the vehicle is stationary, the term "driver" may be understood as including any user of the onboard generator. Additionally, for the purposes of this disclosure, when describing a variable displacement engine, the terms "engine" and "VDE" may be used interchangeably to refer to the variable displacement engine.

Figure 1:
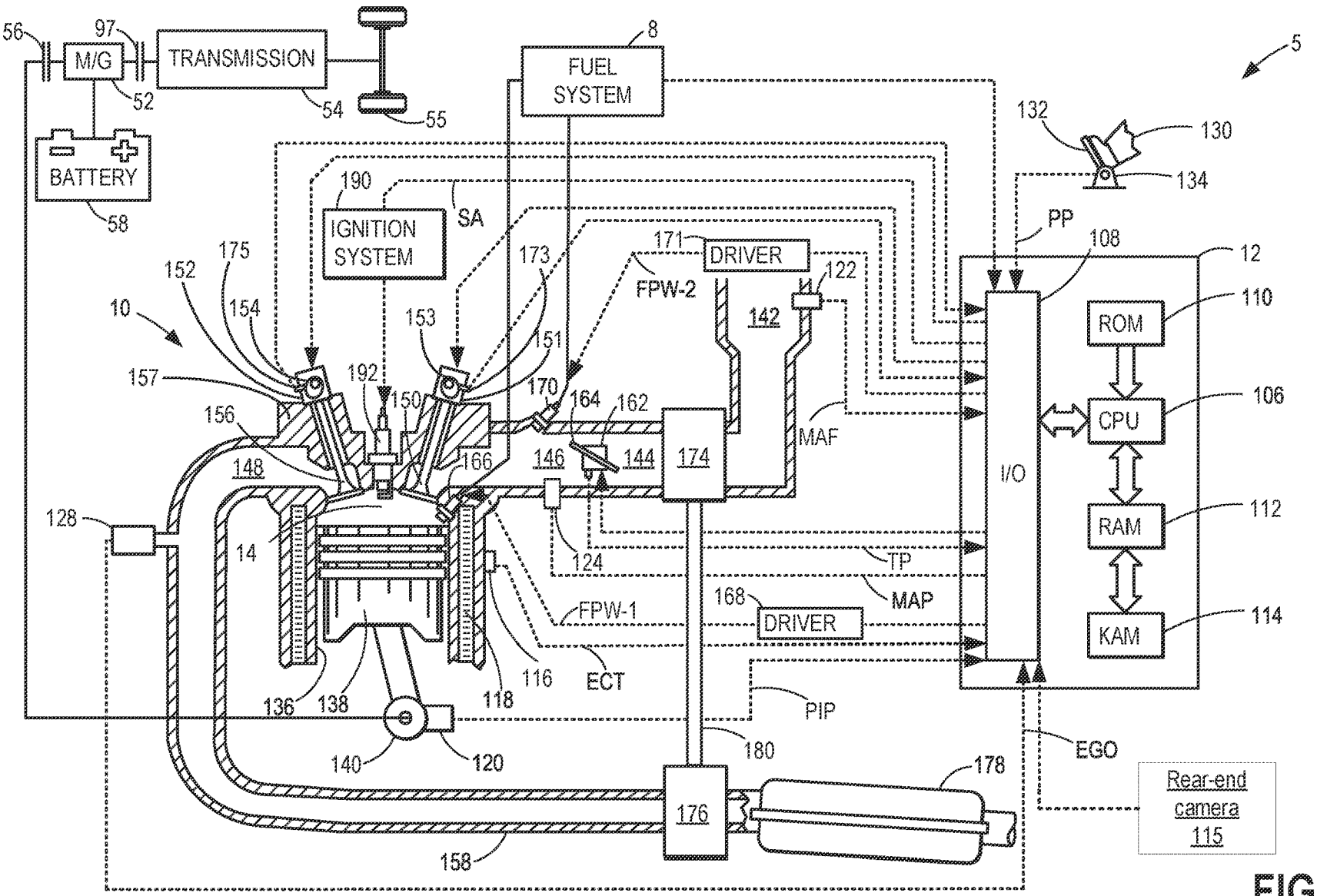
FIG. 1 schematically shows a variable displacement engine including a combustion chamber having intake valves and/or exhaust valves driven via camshaft.

FIG. 1 depicts an example of a combustion chamber or cylinder of an internal combustion engine of a vehicle. The internal combustion engine may be a VDE, such as the VDE depicted in the onboard power generation system of FIG. 2. The onboard power generation system may include an onboard generator, which generates AC power that may be supplied at a power outlet (also referred to herein as the outlet) of the vehicle. A controller of the vehicle may selectively activate and/or deactivate one or more cylinders of the VDE in various configurations of activated and deactivated cylinders. FIG. 3A shows a first example configuration of activated and deactivated cylinders of a V8 engine, where all cylinders of the VDE are activated. FIG. 3B shows a second example configuration of activated and deactivated cylinders where all the cylinders of a first engine bank of the VDE are activated and all the cylinders of a second engine bank of the VDE are not activated. FIG. 3C shows a third example configuration of activated and deactivated cylinders, where a portion of the cylinders of the first engine bank are activated and a portion of the cylinders of the second engine bank of the VDE are activated. FIG. 3C shows a fourth example configuration of activated and deactivated cylinders, where a single cylinder of the VDE is activated. A power draw of an electrical device plugged into the power outlet may be estimated by an example method described in FIG. 4. The controller may selectively activate and/or deactivate one or more cylinders of the VDE at an engine start and/or when a stationary power draw is requested to adjust an amount of power supplied by the generator, in accordance with an example method described in FIG. 5.

Referring to FIG. 1, an example of a combustion chamber or cylinder of internal combustion engine 10 is shown. Engine 10 may be controlled at least partially by a control system including controller 12 and by input from a vehicle operator 130 via an input device 132. In this example, input device 132 includes an accelerator pedal and a pedal position sensor 134 for generating a proportional pedal position signal PP. Cylinder (herein also "combustion chamber") 14 of engine 10 may include combustion chamber walls 136 with piston 138 positioned therein. The cylinder 14 is capped by cylinder head 157. Piston 138 may be coupled to crankshaft 140 so that reciprocating motion of the piston is translated into rotational motion of the crankshaft. Crankshaft 140 may be coupled to at least one drive wheel of the passenger vehicle via a transmission system. Further, a starter motor (not shown) may be coupled to crankshaft 140 via a flywheel to enable a starting operation of engine 10.

Cylinder 14 can receive intake air via a series of intake air passages 142, 144, and 146. Intake air passage 146 can communicate with other cylinders of engine 10 in addition to cylinder 14. In some examples, one or more of the intake passages may include a boosting device such as a turbocharger or a supercharger. For example, FIG. 1 shows engine 10 configured with a turbocharger including a compressor 174 arranged between intake passages 142 and 144, and an exhaust turbine 176 arranged along exhaust passage 148. Compressor 174 may be at least partially powered by exhaust turbine 176 via a shaft 180 where the boosting device is configured as a turbocharger. However, in other examples, such as where engine 10 is provided with a supercharger, exhaust turbine 176 may be optionally omitted, where compressor 174 may be powered by mechanical input from a motor or the engine. A throttle 162 including a throttle plate 164 may be provided along an intake passage of the engine for varying the flow rate and/or pressure of intake air provided to the engine cylinders. For example, throttle 162 may be positioned downstream of compressor 174 as shown in FIG. 1, or alternatively may be provided upstream of compressor 174.

Exhaust passage 148 can receive exhaust gases from other cylinders of engine 10 in addition to cylinder 14. Exhaust gas sensor 128 is shown coupled to exhaust passage 148 upstream of emission control device 178. Sensor 128 may be selected from among various suitable sensors for providing an indication of exhaust gas air/fuel ratio such as a linear oxygen sensor or UEGO (universal or wide-range exhaust gas oxygen), a two-state exhaust gas oxygen sensor or EGO (as depicted), a HEGO (heated EGO), a NOx, HC, or CO sensor, for example. Emission control device 178 may include a three-way catalytic converter, where a three way catalyst (TWC) is used to oxidize exhaust gas pollutants, NOx trap, or other similar emission control devices, or combinations thereof.

Each cylinder of engine 10 includes one or more intake valves and one or more exhaust valves. For example, cylinder 14 is shown including at least one intake poppet valve 150 and at least one exhaust poppet valve 156 located at an upper region of cylinder 14. In some examples, each cylinder of engine 10, including cylinder 14, may include at least two intake poppet valves and at least two exhaust poppet valves located at an upper region of the cylinder.

In the example of FIG. 1, intake valve 150 and exhaust valve 156 are actuated (e.g., opened and closed) via respective cam actuation systems 153 and 154. Cam actuation systems 153 and 154 each include one or more cams mounted on one or more camshafts and may utilize one or more of cam profile switching (CPS), variable cam timing (VCT), variable valve timing (VVT) and/or variable valve lift (VVL) systems that may be operated by controller 12 to vary valve operation. The angular position of intake and exhaust camshafts may be determined by position sensors 173 and 175, respectively. In alternate embodiments, one or more additional intake valves and/or exhaust valves of cylinder 14 may be controlled via electric valve actuation. For example, cylinder 14 may include one or more additional intake valves controlled via electric valve actuation and one or more additional exhaust valves controlled via electric valve actuation. It should be appreciated that the actuation systems described herein are for illustrative purposes, and in other examples, the internal combustion engine 10 may include one or more different cam actuation systems.

Cylinder 14 can have a compression ratio, which is the ratio of volumes when piston 138 is at bottom center to top center. In one example, the compression ratio is in the range of 9:1 to 10:1. However, in some examples where different fuels are used, the compression ratio may be increased. This may happen, for example, when higher octane fuels or fuels with higher latent enthalpy of vaporization are used. The compression ratio may also be increased if direct injection is used due to its effect on engine knock.

In some examples, each cylinder of engine 10 may include a spark plug 192 housed within cylinder head 157 for initiating combustion. Ignition system 190 can provide an ignition spark to combustion chamber 14 via spark plug 192 in response to spark advance signal SA from controller 12, under select operating modes. However, in some embodiments, spark plug 192 may be omitted, such as where engine 10 may initiate combustion by auto-ignition or by injection of fuel as may be the case with some diesel engines.

In some examples, each cylinder of engine 10 may be configured with one or more fuel injectors for providing fuel thereto. As a non-limiting example, cylinder 14 is shown including two fuel injectors 166 and 170. Fuel injectors 166 and 170 may be configured to deliver fuel received from fuel system 8. As elaborated with reference to FIGS. 2 and 3, fuel system 8 may include one or more fuel tanks, fuel pumps, and fuel rails. Fuel injector 166 is shown coupled directly to cylinder 14 for injecting fuel directly therein in proportion to the pulse width of signal FPW-1 received from controller 12 via electronic driver 168. In this manner, fuel injector 166 provides what is known as direct injection (hereafter referred to as "DI") of fuel into combustion cylinder 14. While FIG. 1 shows injector 166 positioned to one side of cylinder 14, it may alternatively be located overhead of the piston, such as near the position of spark plug 192. Such a position may improve mixing and combustion when operating the engine with an alcohol-based fuel due to the lower volatility of some alcohol-based fuels. Alternatively, the injector may be located overhead and near the intake valve to improve mixing. Fuel may be delivered to fuel injector 166 from a fuel tank of fuel system 8 via a high pressure fuel pump, and a fuel rail. Further, the fuel tank may have a pressure transducer providing a signal to controller 12.

Fuel injector 170 is shown arranged in intake passage 146, rather than in cylinder 14, in a configuration that provides what is known as port injection of fuel (hereafter referred to as "PFI") into the intake port upstream of cylinder 14. Fuel injector 170 may inject fuel, received from fuel system 8, in proportion to the pulse width of signal FPW-2 received from controller 12 via electronic driver 171. Note that a single driver 168 or 171 may be used for both fuel injection systems, or multiple drivers, for example driver 168 for fuel injector 166 and driver 171 for fuel injector 170, may be used, as depicted.

In an alternate example, each of fuel injectors 166 and 170 may be configured as direct fuel injectors for injecting fuel directly into cylinder 14. In still another example, each of fuel injectors 166 and 170 may be configured as port fuel injectors for injecting fuel upstream of intake valve 150. In yet other examples, cylinder 14 may include only a single fuel injector that is configured to receive different fuels from the fuel systems in varying relative amounts as a fuel mixture, and is further configured to inject this fuel mixture either directly into the cylinder as a direct fuel injector or upstream of the intake valves as a port fuel injector. As such, it should be appreciated that the fuel systems described herein should not be limited by the particular fuel injector configurations described herein by way of example.

Fuel may be delivered by both injectors to the cylinder during a single cycle of the cylinder. For example, each injector may deliver a portion of a total fuel injection that is combusted in cylinder 14. Further, the distribution and/or relative amount of fuel delivered from each injector may vary with operating conditions, such as engine load, knock, and exhaust temperature, such as described herein below. The port injected fuel may be delivered during an open intake valve event, closed intake valve event (e.g., substantially before the intake stroke), as well as during both open and closed intake valve operation. Similarly, directly injected fuel may be delivered during an intake stroke, as well as partly during a previous exhaust stroke, during the intake stroke, and partly during the compression stroke, for example. As such, even for a single combustion event, injected fuel may be injected at different timings from the port and direct injector. Furthermore, for a single combustion event, multiple injections of the delivered fuel may be performed per cycle. The multiple injections may be performed during the compression stroke, intake stroke, or any appropriate combination thereof.

Fuel injectors 166 and 170 may have different characteristics, such as differences in size. For example, one injector may have a larger injection hole than the other. Other differences include, but are not limited to, different spray angles, different operating temperatures, different targeting, different injection timing, different spray characteristics, different locations etc. Moreover, depending on the distribution ratio of injected fuel among injectors 170 and 166, different effects may be achieved.

Fuel tanks in fuel system 8 may hold fuels of different fuel types, such as fuels with different fuel qualities and different fuel compositions. The differences may include different alcohol content, different water content, different octane, different heats of vaporization, different fuel blends, and/or combinations thereof etc. One example of fuels with different heats of vaporization could include gasoline as a first fuel type with a lower heat of vaporization and ethanol as a second fuel type with a greater heat of vaporization. In another example, the engine may use gasoline as a first fuel type and an alcohol containing fuel blend such as E85 (which is approximately 85% ethanol and 15% gasoline) or M85 (which is approximately 85% methanol and 15% gasoline) as a second fuel type. Other feasible substances include water, methanol, a mixture of alcohol and water, a mixture of water and methanol, a mixture of alcohols, etc.

In some examples, vehicle 5 may be a hybrid vehicle with multiple sources of torque available to one or more vehicle wheels 55. In other examples, vehicle 5 is a conventional vehicle with only an engine, or an electric vehicle with only electric machine(s). In the example shown, vehicle 5 includes engine 10 and an electric machine 52. Electric machine 52 may be a motor or a motor/generator. Crankshaft 140 of engine 10 and electric machine 52 are connected via a transmission 54 to vehicle wheels 55 when one or more clutches are engaged. In the depicted example, a first clutch 56 is provided between crankshaft 140 and electric machine 52, and a second clutch 97 is provided between electric machine 52 and transmission 54. Controller 12 may send a signal to an actuator of each clutch (e.g., first clutch 56 and/or second clutch 97) to engage or disengage the clutch, so as to connect or disconnect crankshaft 140 from electric machine 52 and the components connected thereto, and/or connect or disconnect electric machine 52 from transmission 54 and the components connected thereto. Transmission 54 may be a gearbox, a planetary gear system, or another type of transmission. The powertrain may be configured in various manners including as a parallel, a series, or a series-parallel hybrid vehicle.

Electric machine 52 receives electrical power from a traction battery 58 to provide torque to vehicle wheels 55. Electric machine 52 may also be operated as a generator to provide electrical power to charge battery 58, for example during a braking operation.

As described above, FIG. 1 shows only one cylinder of multi-cylinder engine 10. As such, each cylinder may similarly include its own set of intake/exhaust valves, fuel injector(s), spark plug, etc. It will be appreciated that engine 10 may include any suitable number of cylinders, including 2, 3, 4, 5, 6, 8, 10, 12, or more cylinders. Further, each of these cylinders can include some or all of the various components described and depicted by FIG. 1 with reference to cylinder 14.

Engine 10 is a variable displacement engine, and cylinder 14 may be one of a plurality of deactivatable or non-deactivatable cylinders of the engine 10. For example, one or more valves of the cylinder 14 (e.g., intake valve 150 and/or exhaust valve 156) may be adjustable by the controller 12 from an activated mode to a deactivated mode (and vice versa). For example, cylinder 14 may be a deactivatable cylinder, with the intake valve 150 and exhaust valve 156 each being coupled to respective deactivatable valve assemblies. The deactivatable valve assemblies may be deactivatable via a suitable type of deactivation device, such as via lash adjustment, rocker arm deactivation, roller lifter deactivation, camshaft-type deactivation, etc. In some examples the deactivatable valve assemblies may adjust an operational mode of their corresponding coupled valves in response to signals transmitted to the deactivatable valve assemblies by the controller 12. Intake valve 150 is shown coupled to deactivatable valve assembly 151 and exhaust valve 156 is shown coupled to deactivatable valve assembly 152.

In one example, the controller 12 may transmit electrical signals to the deactivatable valve assembly 151 in order to adjust the operational mode of the intake valve 150 from an activated mode to a deactivated mode (or vice versa) and/or the controller 12 may transmit electrical signals to the deactivatable valve assembly 152 in order to adjust the operational mode of the exhaust valve 156 from an activated mode to a deactivated mode (or vice versa).

Although operation of the cylinder 14 is adjusted via the deactivatable valve assemblies 151 and 152 as described above, in some examples, operation of one or more cylinders of the engine 10 may not be adjusted by deactivatable valve assemblies. For example, the engine 10 may include four cylinders (e.g., cylinder 14), with operation of a first pair of the cylinders being adjustable via deactivatable valve assemblies and operation of a second pair of cylinders not being adjustable via deactivatable valve assemblies.

The controller 12 receives signals from the various sensors of FIG. 1 and employs the various actuators of FIG. 1 to adjust engine operation based on the received signals and instructions stored on a memory of the controller. For example, adjusting the intake valve 150 from the activated mode to the deactivated mode may include adjusting an actuator of the intake valve 150 (e.g., deactivatable valve assembly 151) to adjust an amount of movement of the intake valve 150 relative to cylinder 14. For example, the controller 12 may transmit electrical signals to a hydraulic fluid valve of the deactivatable valve assembly 151 (with the deactivatable valve assembly 151 coupled to the intake valve 150) in order to move the hydraulic fluid valve of the deactivatable valve assembly 151 from the closed position to an opened position. Similarly, the controller 12 may transmit electrical signals to the hydraulic fluid valve of the deactivatable valve assembly 151 in order to move the hydraulic fluid valve to an opened position and thereby adjust the intake valve 150 to the activated mode.

Controller 12 is shown in FIG. 1 as a microcomputer, including microprocessor unit 106, input/output ports 108, an electronic storage medium for executable programs and calibration values shown as non-transitory read only memory chip 110 in this particular example for storing executable instructions, random access memory 112, keep alive memory 114, and a data bus. As discussed herein, memory includes any non-transient computer readable medium in which programming instructions are stored. For the purposes of this disclosure, the term tangible computer readable medium is expressly defined to include any type of computer readable storage. The example methods and systems may be implemented using coded instruction (e.g., computer readable instructions) stored on a non-transient computer readable medium such as a flash memory, a read-only memory (ROM), a random-access memory (RAM), a cache, or any other storage media in which information is stored for any duration (e.g. for extended period time periods, permanently, brief instances, for temporarily buffering, and/or for caching of the information). Computer memory of computer readable storage mediums as referenced herein may include volatile and non-volatile or removable and non-removable media for a storage of electronic-formatted information such as computer readable program instructions or modules of computer readable program instructions, data, etc. that may be stand-alone or as part of a computing device. Examples of computer memory may include any other medium which can be used to store the desired electronic format of information and which can be accessed by the processor or processors or at least a portion of a computing device.

Controller 12 may receive various signals from sensors coupled to engine 10, in addition to those signals previously discussed, including measurement of inducted mass air flow (MAF) from mass air flow sensor 122; engine coolant temperature (ECT) from temperature sensor 116 coupled to cooling sleeve 118; a profile ignition pickup signal (PIP) from Hall effect sensor 120 (or other type) coupled to crankshaft 140; throttle position (TP) from a throttle position sensor; and absolute manifold pressure signal (MAP) from sensor 124. Engine speed signal, RPM, may be generated by controller 12 from signal PIP. Manifold pressure signal MAP from a manifold pressure sensor may be used to provide an indication of vacuum, or pressure, in the intake manifold. Controller 12 may infer an engine temperature based on an engine coolant temperature.

Controller 12 may also receive image data from a rear-end camera 115 of the vehicle. Image data received from the rear-end camera 115 may be used by the controller to estimate a distance between the vehicle and a following vehicle, and/or to estimate a condition of a road or a weather condition, and/or to detect an obstacle in a path of the vehicle when the vehicle is in a reverse gear of the engine 10. In one example, image data received from the rear-end camera 115 is used to input data into the controller 12. For example, the image data received from the rear-end camera 115 may include a quick response (QR) code of an electrical device to be powered or charged by an onboard generator of the vehicle powered by the engine 10. The controller may receive power data of the electrical device via the QR code. In one example, based on the power data, the controller may activate or deactivate one or more cylinders of the engine 10 as described above to adjust an amount of power generated by the engine 10, as described in further detail below in relation to FIGS. 4 and 5.

Figure 2:
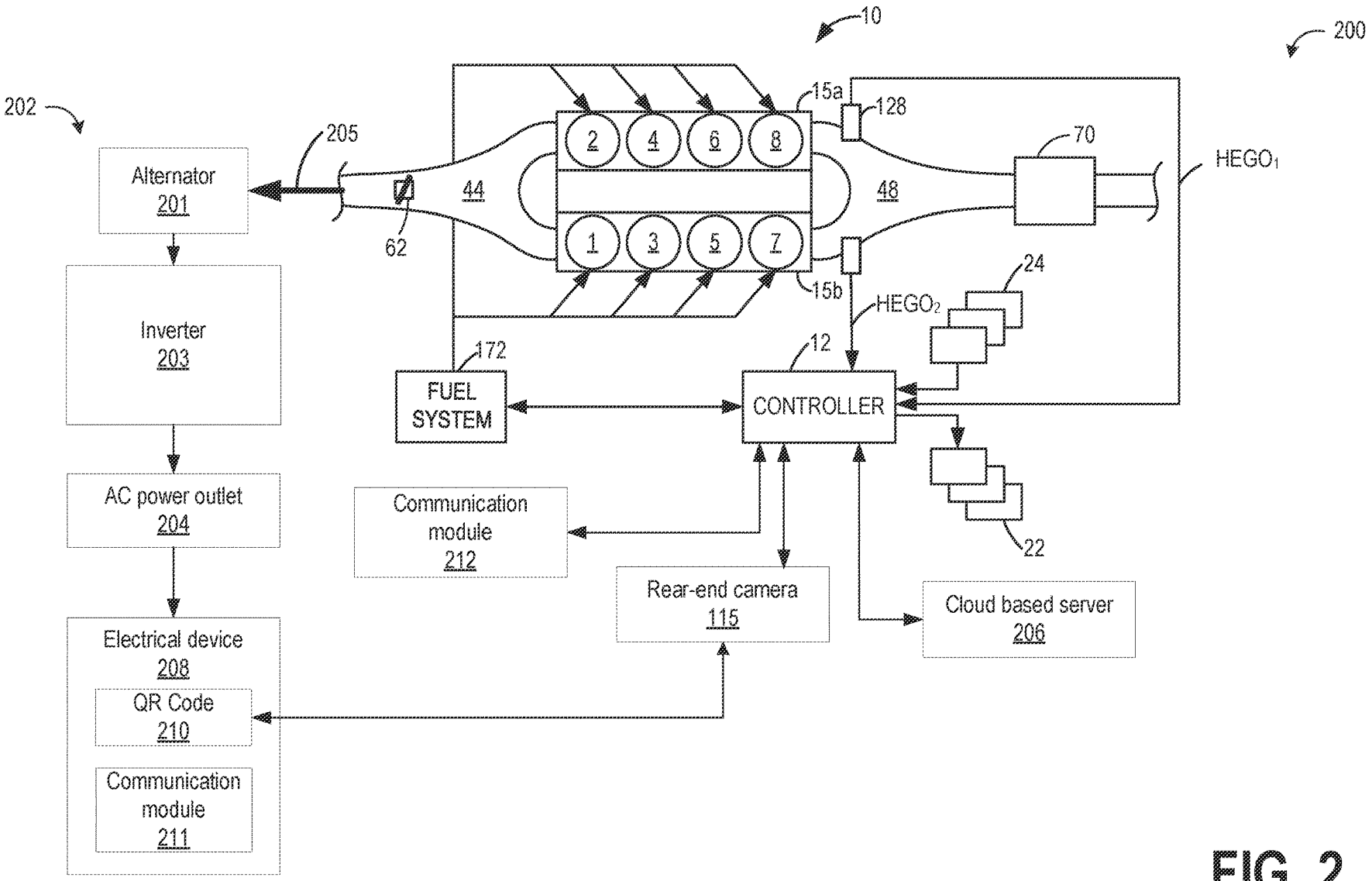
FIG. 2 shows an example layout of an onboard power generation system of a vehicle.
Figures 3A, 3B, 3C, 3D:
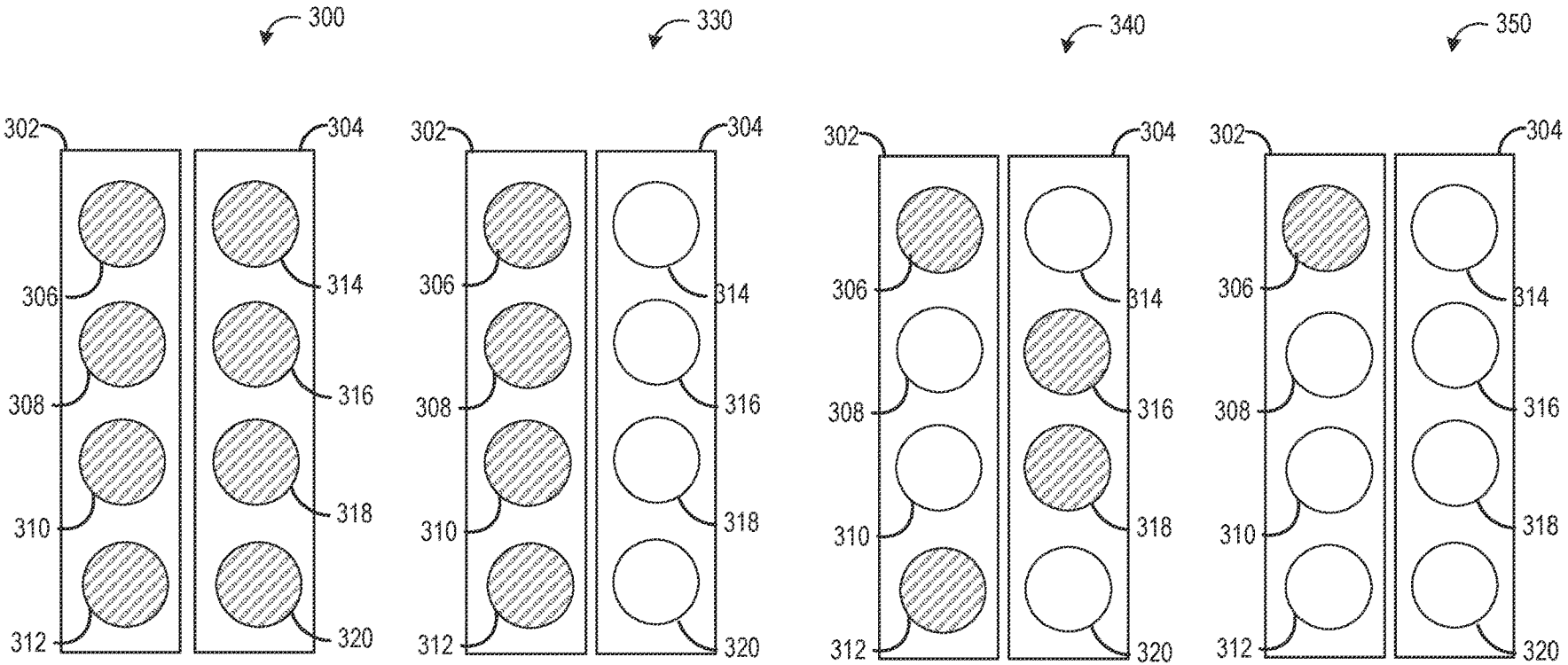
FIG. 3A shows cylinders of an engine in a first configuration of activated and deactivated cylinders.
FIG. 3B shows cylinders of an engine in a second configuration of activated and deactivated cylinders.
FIG. 3C shows cylinders of an engine in a third configuration of activated and deactivated cylinders.
FIG. 3D shows cylinders of an engine in a fourth configuration of activated and deactivated cylinders.

FIG. 2 shows an example onboard power generation system 200, comprising an onboard generator 202 powered by engine 10. Like components of FIGS. 1 and 2 are numbered the same and are not reintroduced. As engine 10 is a variable displacement engine (VDE), engine 10 is also referred to herein as VDE 10. FIG. 2 shows VDE 10 having a first bank 15*a* and a second bank 15*b* of cylinders. In the depicted example, VDE 10 is a V-8 engine with the first and second banks each having four cylinders. However, in alternative embodiments, the engine may have a different number of engine cylinders, such as 4, 6, 10, 12, etc. As shown, cylinder 2, cylinder 4, cylinder 6, and cylinder 8 comprise first bank 15*a*, and cylinder 1, cylinder 3, cylinder 5, and cylinder 7 comprise second bank 15*b*.

VDE 10 has an intake manifold 44, with throttle 62, and an exhaust passage (e.g., exhaust manifold) 48 coupled to an emission control device 70 (e.g., the emission control device 178 of FIG. 1). Two symmetrically opposed exhaust gas oxygen sensors, a first exhaust gas oxygen sensor 128 and a second exhaust gas oxygen sensor 129, are shown coupled to exhaust passage 48 upstream of the emission control device 70. As described with respect to FIG. 1, the first and second exhaust gas oxygen sensors 128 and 129 may be any suitable sensors for providing an indication of an air-fuel ratio of an exhaust gas, such as a UEGO, an EGO, a HEGO, etc. In the depicted embodiment, the first exhaust gas oxygen sensor 128 and second exhaust gas oxygen sensor 129 are HEGO sensors configured to indicate a relative enrichment or leanness of the exhaust gas prior to passing through the emission control device 70. For example, an output voltage of the HEGO sensors may be a nonlinear function of an amount of oxygen present in the exhaust gas, with a lean feed resulting in a relatively low HEGO sensor voltage and a rich feed resulting in a relatively high HEGO sensor voltage. As shown, first HEGO sensor 128 is positioned to measure a zoned exhaust flow from the first bank 15*a*, providing controller 12 with an output signal $HEGO_1$, and second HEGO sensor 129 is positioned to measure a zoned exhaust flow from second bank 15*b*, providing controller 12 with an output signal $HEGO_2$. Emission control device 70 may include one or more catalysts, as described with respect to FIG. 1.

The VDE 10 may be designed to deactivate cylinders en masse, where more than one cylinder may be deactivated at the same time. For example, two cylinders of the VDE 10 may be deactivated, leaving six cylinders of the VDE 10 combusting fuel and two cylinders operating unfueled. The VDE 10 may also be designed as a rolling VDE system where each cylinder may be turned off individually. For example, a first cylinder of the VDE 10 may be deactivated responsive to a first condition, a second cylinder of the VDE 10 may be deactivated responsive to a second condition, a third cylinder of the VDE 10 may be deactivated responsive to a third condition, and so on. Similarly, the VDE 10 may be designed to activate one or more cylinders, either en masse or individually, during operation of the VDE 10 and/or upon startup of the VDE 10. In one example, the VDE 10 may be switched on in an initial configuration of activated and deactivated cylinders. In one example, the initial configuration is based on an estimated power draw of an external electrical device plugged into the onboard generator 202.

During a selected condition, such as when the full torque capability of the engine is not requested, one or more cylinders of the VDE 10 may be deactivated (herein also referred to as a VDE mode of operation). For example, upon the selected condition being met, a cylinder 1 of the VDE 10 may be deactivated, or a cylinder 2 of the VDE may be deactivated, or a cylinder 3 of the VDE 10 may be deactivated, and so on. Additionally, one of a first or a second cylinder group may be selected for deactivation. For example, the first cylinder group may comprise the cylinder 1, a cylinder 4, a cylinder 6, and a cylinder 7, and the second cylinder group may comprise the cylinder 2, a cylinder 3, a cylinder 5, and a cylinder 8. In another example, the first cylinder group may comprise the cylinders of first bank 15*a*, and the second cylinder group may comprise the cylinders of second bank 15*b*. Thus, any number of cylinders of the VDE 10 may be activated or deactivated, individually or in groups, in various configurations. Each configuration of the various configurations may generate an engine torque, where the engine torque of one configuration may or may not be the same as the engine torque of a different configuration. By adjusting the configuration of activated and deactivated cylinders, the engine torque may be increased or decreased. An increase in the engine torque may result in an increased electrical power generated by the VDE 10 (via onboard generator 202), and a decrease in the engine torque may result in a decreased electrical power generated by the VDE 10.

Referring briefly to FIGS. 3A-3D, different example configurations of activated and deactivated cylinders of an internal combustion engine (as described herein, the engine) are shown (e.g., the internal combustion engine 10 of FIGS. 1 and/or 2). In FIG. 3A, an example cylinder activation configuration 300 includes a first cylinder bank 302 and a second cylinder bank 304. The cylinder banks 302 and 304 may be the same as or substantially similar to the cylinder banks 15*a* and 15*b* of FIG. 2. Cylinder bank 302 includes a cylinder 306, a cylinder 308, a cylinder 310, and a cylinder 312. Cylinder bank 304 includes a cylinder 314, a cylinder 316, a cylinder 318, and a cylinder 320. In FIG. 3A, activated cylinders are denoted via circles with hatching and deactivated cylinders are denoted via solid circles. In at least one example, the engine cylinders shown may be all of the cylinders of the engine. Further, in the example shown in FIG. 3A, eight cylinders are shown, though other numbers of cylinders are possible. In at least one example, a firing order of the cylinders is maintained. In FIG. 3A, each of the cylinders 306, 308, 310, and 312 of the cylinder bank 302 are activated, and each of the cylinders 314, 316, 318, and 320 of the cylinder bank 304 are activated, whereby all of the cylinders of the engine are activated.

In FIG. 3B, an example cylinder activation configuration 330 is shown where each of the cylinders 306, 308, 310, and 312 of the cylinder bank 302 are activated, and each of the cylinders 314, 316, 318, and 320 of the cylinder bank 304 are not activated, whereby half of the cylinders of the engine (e.g., corresponding to the cylinder bank 302) are fired with fuel to generate a torque of the engine, and half of the cylinders of the engine (e.g., corresponding to the cylinder bank 304) are fired unfueled, and do not generate a torque. When half of the cylinders of the engine are activated, the torque of the engine may be half of a torque generated when all of the cylinders of the engine are activated.

When the cylinders 306, 308, 310, and 312 of the cylinder bank 302 are activated and the cylinders 314, 316, 318, 320 of the cylinder bank 304 are not activated, an imbalance may be generated due to the cylinders 306, 308, 310, and 312 of the cylinder bank 302 firing and the cylinders 314, 316, 318, 320 of the cylinder bank 304 not firing. The imbalance may result in a noise, vibration, and harshness (NVH) of the engine. In some examples, the NVH may be reduced by balancing a firing of one or more cylinders of the cylinder bank 302 with a firing of one or more cylinders of the cylinder bank 304. In FIG. 3C, an example cylinder activation configuration 340 is shown where cylinders 306 and 312 of cylinder bank 302 are activated and cylinders 308 and 310 are deactivated, and where cylinders 316 and 318 of cylinder bank 304 are activated and cylinders 314 and 320 of cylinder bank 304 are not activated. As a result of cylinder bank 302 and cylinder bank 304 each having the same number of activated cylinders, an NVH of the example configuration 340 may be less than the NVH of the example configuration 330.

FIG. 3D shows an example cylinder activation configuration 350 the cylinder 306 of the cylinder bank 302 is activated, and each of the cylinders 308, 310, and 312 of the cylinder bank 302 are not activated, and where each of the cylinders 314, 316, 318, and 320 of the cylinder bank 304 are not activated. In this example configuration, the torque generated by the engine is the torque generated by the cylinder 306. As a result of the torque generated by the engine being the torque generated by the cylinder 306, an amount of torque generated by the engine may be substantially less than the torque of the engine in the example cylinder activation configurations 340, 330, and 300.

Returning to FIG. 2, as described above with respect to FIG. 1, each cylinder may include one or more fuel injectors (e.g., fuel injector 66 of FIG. 1) and intake and exhaust valves (e.g., intake valve 52 and exhaust valve 54 of FIG. 1). During VDE mode, cylinders of the selected group of cylinders may be deactivated by shutting off respective fuel injectors and deactivating respective intake and exhaust valves. While fuel injectors of the disabled cylinders are turned off, the remaining enabled cylinders continue to carry out combustion, with corresponding fuel injectors and intake and exhaust valves active and operating. To meet torque requirements, the engine produces the same amount of torque on active cylinders. This requires higher manifold pressures, resulting in lowered pumping losses and increased engine efficiency. Additionally, the lower effective surface area (from the enabled cylinders and not the disabled cylinders) exposed to combustion reduces engine heat losses, improving the thermal efficiency of the engine.

The VDE 10 may operate on a plurality of substances, which may be delivered to each cylinder via a fuel system 172. VDE 10 may be controlled at least partially by a control system, including controller 12. In addition to $HEGO_1$ from first HEGO sensor 128 and $HEGO_2$ from second HEGO sensor 129, controller 12 may receive various signals from sensors 24 coupled to VDE 10 (e.g., MAF sensor 120 of FIG. 1, MAP sensor 122 of FIG. 1, Hall effect sensor 118 of FIG. 1, etc.) and send control signals to various actuators 22 coupled to the engine and/or vehicle (e.g., throttle 62, EGR valve 142 of FIG. 1, fuel injector 66 of FIG. 1, etc.).

Controller 12 may also receive images from a rear-end camera 115. In one example, the rear-end camera 115 may be accessed by a control routine of the controller 12 to receive power data of an external electrical device 208 (e.g., an electrical device that is not part of the vehicle) prior to the electrical device being powered by the onboard generator 202 of the vehicle. For example, a driver of the vehicle may plug the electrical device 208 into the onboard generator 202 via an AC power outlet 204 of the vehicle coupled to the onboard generator 202. Prior to switching on the onboard generator 202, the driver may position a QR code 210 of the electrical device 208 (e.g., on a tag of the electrical device 208) within a view frame of the rear-end camera 115. The controller 12 may read the QR code 210 via the rear-end camera 115 to estimate a power draw of the electrical device 208. In one example, the controller may estimate the power draw by looking up the power draw of the electrical device 208 in a lookup table stored in a memory of the controller (e.g., the memory chip 110 of controller 12 of FIG. 1). In other examples, the lookup table may be stored in a memory of a cloud-based server 206, and the controller 12 may connect to the cloud-based server 206 (e.g., via a modem of the vehicle) to access the lookup table.

In one example, the onboard generator 202 includes an alternator 201 and a pure sine wave inverter 203 that converts direct current (DC) power to AC power to be supplied to one or more electrical devices external to the vehicle (e.g., the electrical device 208). The DC power may be generated by the VDE 10 via the alternator 201 of the vehicle coupled to a drive shaft of the vehicle, where a torque output of the VDE 10 (depicted by arrow 205) is converted into DC power by the alternator 201. The AC power may be supplied via the AC power outlet 204, which may be arranged in a bed of the vehicle or in a cabin of the vehicle, such that a driver may plug the electrical device 208 of the one or more electrical devices into the power outlet and receive an AC current to power the electrical device 208. In one example, the onboard generator is invoked manually by a driver or driver via a dashboard control (e.g., a button). In another example, onboard generator is invoked externally from a key fob, via a computing device (e.g., smart phone) coupled (e.g., wirelessly) to the vehicle, etc.

The onboard generator 202 may provide electrical energy at 120V. In embodiments in which the vehicle is a hybrid vehicle, the onboard generator may provide increased electrical energy (e.g., 120V or 240V, 7400 W). A current available at a power outlet of the one or more power outlets may vary depending on a mode of the vehicle. For example, the onboard generator 202 may operate in one of a mobile mode (e.g., when the vehicle is in motion) or a stationary mode (e.g., when the vehicle is parked and not in motion). In one example, a transmission of the vehicle (e.g., the transmission 54 of FIG. 1) may be locked during the stationary mode so the vehicle does not move while electrical loads are connected to the onboard generator 202. While operating in the mobile mode, the current available at the AC power outlet 204 may be lower (e.g., 400 W) than the current available at the AC power outlet 204 when operating in the stationary mode (e.g., 2000 W) as a result of engine torque being used to propel the vehicle (and drive the front-end accessory drive (FEAD)), a desire to conserve battery power to enable an electric motor to propel the vehicle, and/or a portion of the power generated by the VDE 10 being diverted to one or more electrical devices of the vehicle (e.g., electrical pump(s), fans, heated seats, etc.). When the onboard generator 202 is operating in the stationary mode, if a driver of the vehicle initiates operation of the vehicle, the onboard generator 202 may switch to the mobile mode, whereby a current available at the AC power outlet 204 may decrease.

A load of the electrical device 208 plugged into the vehicle at the AC power outlet 204 may be estimated by the controller 12. In one example, the load is measured using an onboard current amperage probe when the electrical device 208 is plugged into the AC power outlet 204. However, determining the load of the electrical device 208 based on the output of the current amperage probe demands the electrical device 208 be provided power, and thus the current amperage probe cannot estimate the load of the electrical device before the onboard generator is operated to provide power. Thus, in some examples, the electrical device 208 may communicate device description and power demand data to the controller 12 via a wireless connection. For example, as shown in FIG. 2, the electrical device 208 may include a communication module 211 (e.g., including a transmitter) configured to communicate with a communication module 212 of the vehicle (e.g., including a receiver configured to receive information from the transmitter of the communication module 211). The communication occurring via the communication module 211 and the communication module 212 may include direct wireless communication (e.g., via Bluetooth® which includes communication over a frequency range of 2.400 to 2.4835 GHz or WiFi which includes communication over a frequency bands of 2.4 GHz or 5 GHz), indirect wireless communication (e.g., where the communication module 211 communicates with a server or other suitable device that in turn communicates with the communication module 212), infrared (IR) communication, and/or other suitable wireless communication methods. In some examples, the electrical device 208 may include a radio frequency identification tag (RFID) tag. For example, the RFID tag may be programmed with power data of the electrical device 208 prior to being plugged into the onboard generator 202 (e.g., by a manufacturer of the electrical device 208). The RFID tag may be passive or active, and the vehicle may include a reader to receive the information conveyed by the RFID tag. In other examples, the load is inferred from historical usage pattern, where a driver of the vehicle may predictably use the onboard generator 202 to operate electrical device 208 based on a profession of the driver (e.g., weed control business operating in public, plumbing business operating in electric auger, etc.). For example, a historical usage pattern may be that the electrical device 208 is typically a 2-phase 240V air compressor to winterize sprinklers during fall months, or a 240V phase welder to perform a welding job. The controller 12 may learn the historical usage pattern, and use the historical usage pattern to predict a power draw of the electrical device 208.

Responsive to an estimated power draw (e.g., estimated via the onboard current amperage probe, communication from a smart device, and/or predicted from the historical usage pattern), the controller 12 may control the activation of one or more engine cylinders of the VDE 10 at startup of the VDE 10 to deliver a torque that generates a minimally sufficient power to cover the power draw of the electrical device 208. For example, most or all of the cylinders 1, 2, 3, 4, 5, 6, 7, and/or 8 may be activated to satisfy a high power demand (e.g., the 2-phase 240V air compressor, the 240V phase welder, etc.). Alternatively, one or a few of the cylinders 1, 2, 3, 4, 5, 6, 7, and/or 8 may be activated to power a device with a lower power demand (e.g., a cell phone, laptop, etc.). Thus, the VDE may not start by default with all cylinders combusting, but may rather estimate and/or predict how many cylinders to fuel to produce a torque sufficient to meet the power draw based on deterministic or historical power demand, and activate a minimally sufficient number of cylinders to meet the power demand of the electrical device 208 from a first crank of the VDE 10.

In some examples, an additional condition for starting the onboard generator 202 may be that the transmission of the vehicle is locked. If the transmission is locked, there may be a low probability that additional engine loads will be commanded (e.g., that the driver will initiate operation of the vehicle, or turn on one or more electrical accessories of the vehicle). As a result of there being a low probability that additional engine loads will be commanded, the controller may more accurately estimate an amount of power to deliver at the AC power outlet 204 to cover the power draw of the electrical device 208.

From the estimated power draw, a number of usage hours of the electrical device 208 may be predicted, and the driver may be notified (e.g., via a dashboard display, audio clip, etc.). For example, the controller may measure an amount of fuel in a fuel tank of the vehicle via a fuel tank sensor, and based on the amount of fuel in the fuel tank, estimate a duration of power availability at a current engine load and fuel consumption (e.g., until a threshold amount of fuel is reached, below which power may not be supplied via the onboard generator 202). Further, if the current engine load changes (e.g., if the driver plugs in an additional device, or a different device, or turns on an electrical accessory of the vehicle), the controller may update the estimated duration of power availability and notify the driver.

Additionally, an activation and/or deactivation of one or more engine cylinders of the VDE 10 may be controlled proactively, where if the controller 12 has a priori knowledge that the estimated power draw may be high, the controller 12 may condition an availability of the onboard generator 202 on a threshold engine speed being achieved (e.g., a base engine idle speed of 500 RPM, plus 200 RPM per activated cylinder), or an engine temperature reaching a threshold temperature, in anticipation of the high electric load. In other words, for light loads, one or more cylinders may be deactivated on engine start, and for heavy loads, a use of the onboard generator 202 may be delayed until the VDE 10 warms or revs up enough to prevent stalls.

When the VDE 10 is started with one or more cylinders deactivated (e.g., to power the onboard generator 202), preference may be given to a catalyst light-off over other electrical loads when the onboard generator 202 is invoked by using a cold start emissions reduction (CSER) strategy. During cold starts in normal operation (e.g., when an engine is cold relative to a normal operating temperature of the engine), under the CESR strategy, the controller 12 typically retards a spark of a spark plug of the vehicle (e.g., to initiate a combustion event in a cylinder) to generate heat and warm up the catalyst quickly. By delaying the spark, more energy from the combustion event is converted into heat and less energy from the combustion event is transferred to a piston of the cylinder. As a result, an increased amount of heat is transferred to the exhaust system of the vehicle and the emissions control device 70, thereby heating the catalyst and decreasing a time to catalyst light-off. The CSER strategy may also include opening an exhaust valve of the cylinder early (e.g., earlier than would occur during normal operation of the VDE 10) to allow the heat from the combustion event in the cylinder into the exhaust system, thereby increasing a temperature of the catalyst.

During a cold start, the CESR strategy reduces engine torque as the exhaust valve is opened in the power stroke to heat up the catalyst quickly to reduce emissions. Thus, the CSER strategy strikes a balance between a request for engine torque to power loads and warming up the catalyst quickly, since diverting a portion of the combustion event into the exhaust system may reduce engine power used for an electrical and FEAD demand of the vehicle or an electrical demand of the driver inside the cabin (e.g., from heated seats, radio, etc.), which increase an alternator load. To meet driver electrical demand during and/or after a crank event, the CSER strategy may be scaled down to provide additional engine torque to support the electrical demand of the driver. This prolongs the light-off of the catalyst and increases tailpipe emissions.

However, when the VDE 10 is started to power the onboard generator 202 (e.g., and not to power the vehicle) when the transmission is locked, the electrical and FEAD demand of the vehicle and the electrical demand of the driver inside the cabin may be reduced or eliminated, rendering a diversion of the combustion event to electrical loads of the vehicle unnecessary. As a result, preference may be given to lighting off the catalyst while suppressing engine loads. As starting an engine in VDE mode produces less exhaust heat (since fewer cylinders are combusting), the spark retard and exhaust valve early opening may be adjusted to a maximum to warm up the catalyst in a minimum amount of time. This strategically diverts most or all of a cylinder combustion heat toward the exhaust system. In other words, engine torque may be maintained at a minimum as there is low probability of a drive cycle being initiated or driver cabin-initiated electrical requests. Once the catalyst has lit off, the alternator 201, in-cabin electrical loads, and other engine and FEAD loads may no longer be suppressed. During a catalyst warm-up mode, the controller 12 may display a notification to the driver to indicate that the engine is warming up and that the driver should wait. For example, the controller 12 may display a message on the dashboard, adjust an illumination of the AC power outlet 204, etc.

If the driver enters the cabin and demands torque (e.g., by turning on the engine to start the vehicle or by turning on an accessory of the vehicle), one or more deactivated cylinders of the VDE 10 may be activated to satisfy the demand. As a result of deactivating one or more cylinders of the engine, the driver may be able to use the electrical device 208 longer, since less fuel is being consumed with the one or more cylinders deactivated.

Figure 4:
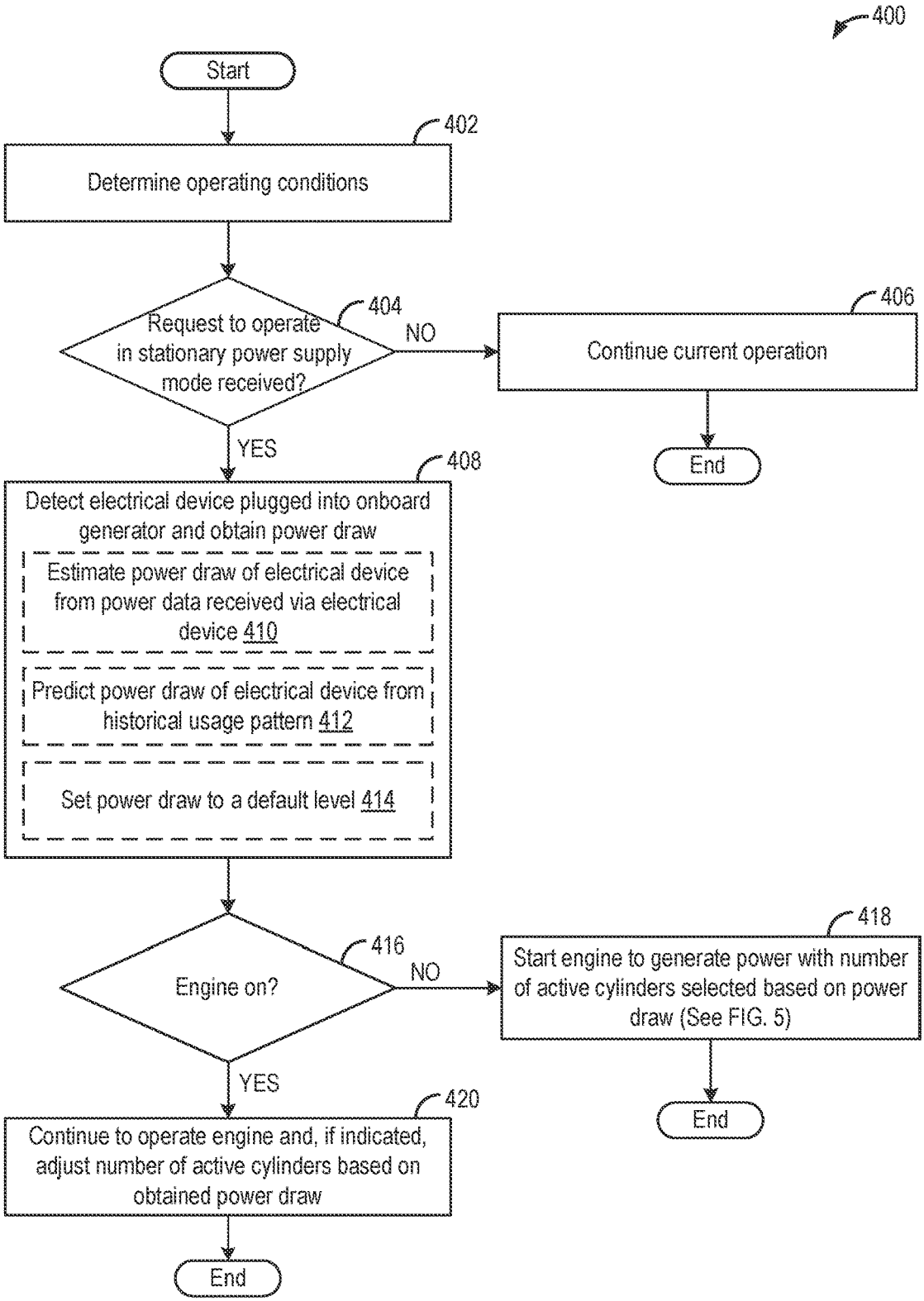
FIG. 4 shows a flow chart illustrating an example method for estimating a power draw of an electrical device.

Referring now to FIG. 4, an exemplary method 400 is shown for estimating a power draw of an electrical device (e.g., the electrical device 208 of FIG. 2) plugged into an onboard generator (e.g., the onboard generator 202 of FIG. 2) of a vehicle via a power outlet (e.g., the AC power outlet 204 of FIG. 2) of the vehicle (e.g., in a bed of a truck, etc.). Instructions for carrying out method 400 and the rest of the methods included herein may be executed by a controller (e.g., the controller 12 of FIGS. 1 and 2) based on instructions stored on a memory of the controller and in conjunction with signals received from sensors of an engine system of the vehicle, such as the sensors described above with reference to FIG. 1. The controller may employ engine actuators of the engine system to adjust operation of an engine of the vehicle, according to the methods described below.

At 402, method 400 includes estimating and/or measuring engine operating conditions. For example, operating conditions may include, but are not limited to, a status of the engine (e.g., determining whether a VDE of the vehicle is switched on where at least one cylinder of the plurality of cylinders is firing) and a status of a transmission of the vehicle (e.g., determining whether a transmission of the vehicle is in a locked state such as a parked condition).

At 404, method 400 includes determining if a request to operate in a stationary power supply mode has been received. The stationary power supply mode may include the engine being operated while the vehicle is stationary (e.g., with the transmission locked) with the engine torque being used to generate electricity to power one or more external electrical devices, such as devices plugged into one or more electrical outlets of the vehicle. The stationary power supply mode may be requested by an operator (e.g., the driver) via a suitable user input, such as an input to a vehicle panel (e.g., a touchscreen or button on the dashboard or another location in the vehicle), an input to a computing device in communication with the vehicle (e.g., a smartphone), or an input to a key fob.

If a request to operate in the stationary power supply mode has not been received, method 400 proceeds to 406 to continue current operation. Continuing the current operation may include maintaining the vehicle in a stationary mode with the engine off, or maintaining the vehicle in a stationary mode or mobile mode with the engine on, and without power being supplied via the onboard generator to any external electrical devices. However, in some examples, an operator may request to operate in a mobile power supply mode, where the vehicle is being propelled (e.g., by the engine and/or an electric motor) and engine torque is used to generate power via the onboard generator for one or more external electrical devices. In such examples, the number of active cylinders of the engine may be adjusted based on an estimated power draw of the one or more electrical devices, which will be described in more detail below. Further, in examples where the vehicle is being propelled by an electric motor and not the engine, and a request to operate in the mobile power supply mode is received, the engine may be started while the vehicle is in motion, with a number of activated cylinders of the engine at and following the engine start determined based on the power draw of the one or more external electrical devices.

If a request to operate in the stationary power supply mode has been received, method 400 proceeds to 408 to detect an electrical device plugged into the onboard generator and obtain a power draw of the electrical device. In some examples, obtaining the power draw may include estimating the power draw of the electrical device from power data received via the electrical device, as indicated at 410. When the electrical device is plugged into the onboard generator and/or when a request to operate the onboard generator is received, the controller may attempt to receive power data of the electrical device. The power data may include an estimated power draw (e.g., current) of the electrical device in one or more modes of operation. As described earlier in relation to FIG. 2, if the electrical device is configured for wired or wireless communication with the vehicle (e.g., a smart phone, etc.), the electrical device may transmit the power data to the controller wirelessly. For example, the electrical device may be Bluetooth® enabled, and may establish a Bluetooth® connection with the controller to transmit the power data. Alternatively or additionally, the electrical device may have an RFID tag, where the RFID tag may transmit the power data to the controller wirelessly. In another example, a rear-end camera of the vehicle may be used to receive the power data via a QR code on a tag of the electrical device. For the purposes of this disclosure, the QR code may also refer to any other similar bar code and/or machine readable/scannable code. For example, a driver of the vehicle may wish to power an electric hand tool plugged into the onboard generator. Prior to switching on the onboard generator (e.g., via a button on the dashboard, a key fob, etc.), the driver may position the QR code of the electric hand tool (e.g., on a tag of the electric hand tool) within a view frame of the rear-end camera. The controller may read the QR code via the rear-end camera to estimate a power draw of the electric hand tool. As described earlier, the controller may estimate the power draw by looking up the power draw of the electrical hand tool in a lookup table stored in a memory of the controller or on a cloud-based server, or the controller may obtain the power draw information from a remote/external service. The controller may transform the QR code image data into identification data that may be entered into the look-up table or sent to the cloud-based server or remote/external service.

In one example, when the driver plugs in the electrical device, the controller determines whether power data for the electrical device is available wirelessly. If the power data is available wirelessly, the controller receives the power data via a wireless connection. If the power data is not available wirelessly, the controller determines whether the power data may be received via a QR code presented at the rear-end camera. In some examples, the controller may prompt the driver to present the QR code at the rear-end camera, and/or may delay a prompt until a threshold duration is reached (e.g., 30 seconds). In other examples, the controller may not prompt the driver, and if the threshold duration is reached, the controller may determine that the power data may not be received via the rear-end camera. In still other examples, the controller may attempt to receive the power data via a wireless connection and/or may not prompt the driver and/or may not attempt to determine whether the power data may be received via a QR code presented at the rear-end camera until the onboard generator is switched on.

In some examples, the power data includes the power draw of the electrical device. In other examples, the power draw may be estimated, inferred and/or predicted from the power data. For example, the power data may specify that the power draw depends on one or more settings, where the electrical device has a first power draw corresponding to a first setting a second power draw corresponding to a second setting, and so forth. The power data may specify that the power draw depends on one or more conditions of use. For example, a power saw may have a first power draw when cutting a first material, a second power draw when cutting a second material, etc. The power data may specify that the power draw depends on one or more environmental conditions of the tool. For example, an electrical device may have a larger power draw when the electrical device is hotter (e.g., due to an increased demand for current as a result of a decreased conductivity of elements of the device). In one example, the controller estimates the power draw based on an algorithm, which may consider factors such as a type of the electrical device, a likely use of the electrical device, a season, a temperature of the environment, etc. Additionally, the algorithm may consider historical and/or statistical data, such as a historical use of the device by the driver, a time of use of the electrical device (e.g., at night, during the day, morning, afternoon, etc.) It should be appreciated that the examples and factors described herein are for illustrative purposes and other factors and/or data may be considered without departing from the scope of this disclosure.

In some examples, obtaining the power draw may include predicting the power draw of the electrical device from a historical usage pattern, as indicated at 412. For example, past use of the onboard generator may be recorded by the controller and stored in a memory of the controller, or stored on a remote server accessible by the controller (e.g., via a modem of the vehicle). In some examples, the controller pushes/pulls historical power consumption data to/from the server over a network. In one example, the controller may retrieve historical examples of usage of the onboard generator (e.g., from the memory and/or the remote server), and determine whether a current usage of the electrical device matches a historical usage pattern of the onboard generator. For example, the vehicle may be driven solely by a lawn maintenance worker, who may plug an electric lawn mower into the onboard generator (e.g., via the power outlet) regularly during working hours, and may not plug in other electrical devices. From the historical examples of usage of the onboard generator, the controller may identify a historical usage pattern that the onboard generator is historically (e.g., frequently and/or regularly) used by an electrical device with a corresponding power draw during working hours.

The power draw of the electrical device may then be predicted from the historical usage pattern. Continuing with the example described above, the controller may predict that a device with no associated power data that is plugged into the onboard generator during working hours has a high probability of being the device that has been historically used (the electric lawn mower) by the user of the vehicle (the lawn maintenance worker). As a result of predicting that the device with no associated power data plugged into the onboard generator during working hours has a high probability of being the device that has been historically used, the controller may predict that the power draw of the electrical device plugged into the vehicle is substantially similar to a historical power draw from the historical usage pattern of the onboard generator.

As another example, the controller may identify distinct historical usage patterns of the onboard generator corresponding to distinct electrical devices, which may be stored on-board the vehicle and/or in the cloud-based server and updated periodically after each electric device usage event. For example, a first historical usage pattern may indicate that a first electrical device with a first power draw is regularly or frequently plugged into the onboard generator during weekday mornings, while a second historical usage pattern may indicate that a second electrical device with a second power draw is frequently plugged into the onboard generator during weekday afternoons. From the first and second historical usage patterns, the controller may predict that an electrical device plugged into the onboard generator in the morning is the first electrical device, and that an electrical device plugged into the onboard generator in the afternoon is the second electrical device.

In still further examples, obtaining the power draw may include setting the power draw to a default level, as indicated at 414. For example, if the power draw of the electrical device is not estimated from power data received by the electrical device, and the power draw is not predicted from a historical usage pattern, the controller defaults to a power draw of the electrical device that is not below a threshold power draw, where the threshold power draw is a power draw that demands all cylinders of the engine of the vehicle to be active and/or firing. As a result of the power draw of the electrical device not being estimated to be below the threshold power (e.g., a default case, where no power draw predictions are made) the VDE may not start in a VDE mode where one or more cylinders of the VDE are deactivated at engine start, to ensure that sufficient power is generated to cover the power draw.

At 416, method 400 includes determining if the engine is currently on (e.g., with at least one cylinder firing). If the engine is not currently on, method 400 proceeds to 418 to start the engine to generate power to cover the power draw. The engine may be started with a number of active cylinders (e.g., all cylinders, or fewer than all cylinders) selected based on the estimated/predicted power draw. Starting the engine to generate power to cover the power draw is described below in reference to FIG. 5.

If the engine is currently on, method 400 proceeds to 420 to continue to operate the engine and, if indicated, adjust the number of active cylinders based on the power draw. For example, the engine may be idling with all cylinders active when the request to operate in the stationary power mode is received. The obtained power draw may be relatively low (e.g., due to the electrical device being a cell phone) and thus not all cylinders may be demanded to generate sufficient power to power the electrical device. In such examples, one or more cylinders may be deactivated in response to the request and the determination of the low power drawn. Method 400 then ends.

Figure 5:
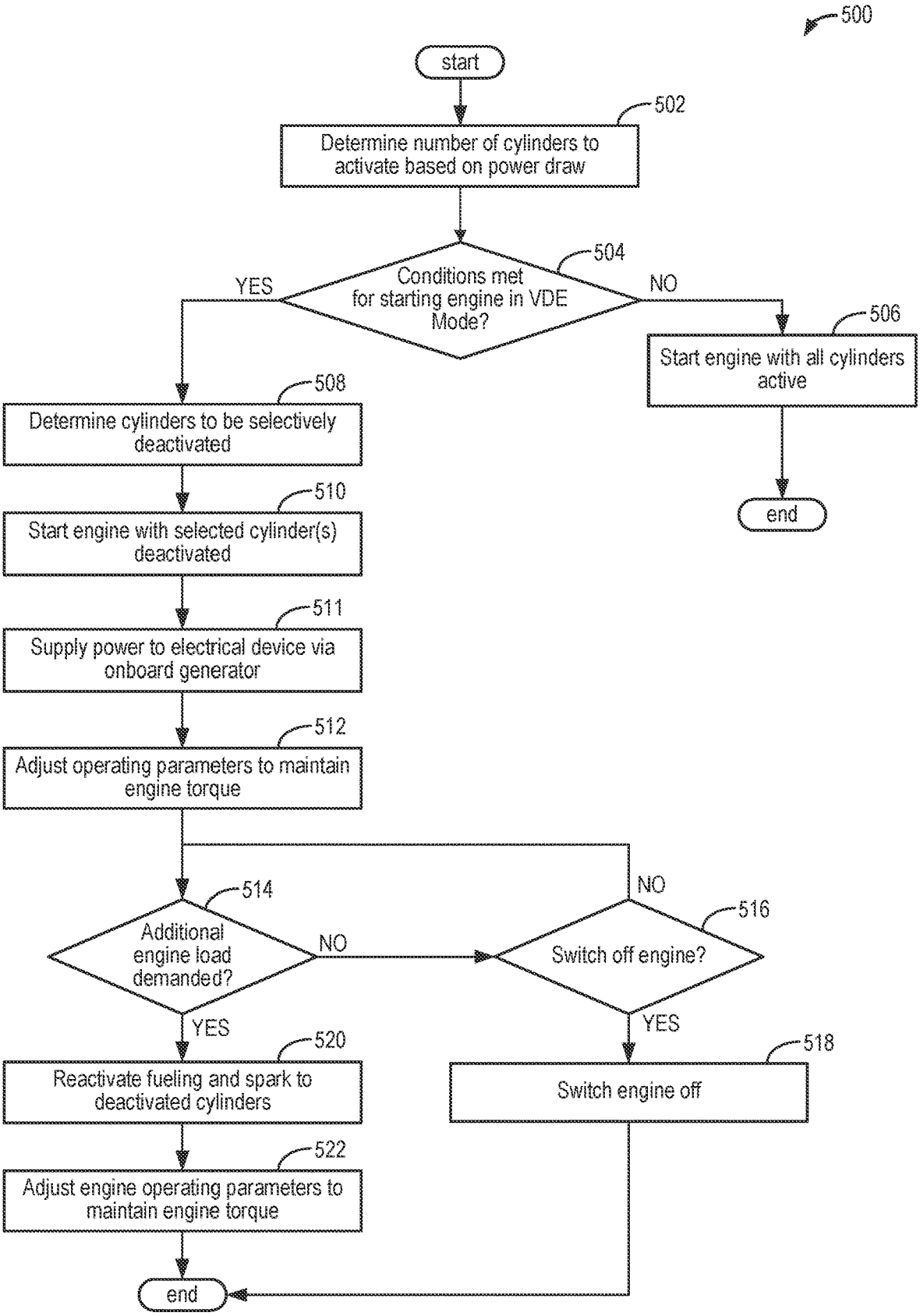
FIG. 5 shows a flow chart illustrating an example method for operating an engine in VDE mode.

Turning to FIG. 5, an exemplary method 500 is shown for starting an engine of a vehicle (e.g., the engine 10 of FIG. 1 and/or the VDE 10 of FIG. 2) based on a power demand of an external electrical load. In some examples, the engine may be operated in a VDE mode, where one or more cylinders of a plurality of cylinders of the engine are deactivated at engine start to reduce a torque of the engine. By reducing a torque of the engine, an amount of power generated by the engine and a corresponding amount of emissions released into the atmosphere may be reduced. In one example, the amount of power generated by the engine may be reduced to supply a sufficient power to an onboard generator of the vehicle (e.g., the onboard generator 202 of FIG. 2) to cover a power draw of an electrical device plugged into an AC power outlet (herein, the power outlet) of the vehicle coupled to the onboard generator, where an amount of additional power generated is minimized. Method 500 may be executed by a controller of the vehicle (e.g., the controller 12 of FIGS. 1 and 2) as part of method 400 above.

Method 500 begins at 502, where method 500 includes determining a number of active cylinders for starting the engine based on the power draw. In one example, the power draw corresponds to a predicted or estimated power draw of the electrical device plugged into the onboard generator of the vehicle, as explained above with respect to FIG. 4. In some examples, the power draw may be less than a threshold power draw. The threshold power draw may be an amount of power generated by the onboard generator when all of the plurality of cylinders of the engine are active and firing. In other examples, the power draw may not be less than the threshold power draw. When the power draw is less than the threshold power draw, fewer than all cylinders of the engine may be activated at engine start. When the power draw is equal to or greater than the threshold power draw, all cylinders may be activated at engine start.

At 504, method 500 includes determining whether conditions for starting the engine in the VDE mode are met. The conditions for starting the engine in the VDE mode may include the vehicle being stationary with the engine switched off, where none of the plurality of cylinders are active and/or firing. The conditions for starting the engine in the VDE mode may also include a transmission of the vehicle being in a locked state (e.g., where the onboard generator runs in a stationary mode and not a mobile mode of operation). However, in some examples, the conditions for starting the engine in the VDE mode may not include the vehicle being stationary, but may instead include a request for onboard power generation while the vehicle is being propelled by an electric motor.

In one example, the conditions are met to start the engine in the VDE mode when the power draw is less than the threshold power draw. For example, if a driver plugs an electrical device with a high power draw (e.g., a heavy-duty power tool) into the power outlet, the power draw may not be less than the threshold power draw, the engine may be started with all the cylinders of the plurality of cylinders of the engine activated (e.g., and no cylinders deactivated) to cover the power draw (e.g., to power the tool). If the driver plugs an electrical device with a lower power draw (e.g., a light-duty power tool) into the power outlet, the power draw may be less than the threshold power draw, and thus the conditions to start the engine in the VDE mode are met. As a result, the engine may activate a portion of the cylinders, where the activated portion of cylinders generates sufficient torque to generate enough power to cover the power draw (e.g., to power the tool). If the driver plugs an electrical device with a low power draw (e.g., a cell phone) into the power outlet, the power draw may be less than the threshold power draw and below a second threshold power draw, and the engine may be started in the VDE mode with a single cylinder activated, where the activated cylinder generates sufficient torque to cover the power draw (e.g., to charge the cell phone).

If at 504 VDE mode conditions are not met, method 500 proceeds to 506. At 506, method 500 includes starting the engine with all the cylinders activated (e.g., a normal engine start). For example, fuel injectors (e.g., fuel injector 66 of FIG. 1), intake and exhaust valves (e.g., intake valve 52 and exhaust valve 54 of FIG. 1), and spark ignition may be activated for each cylinder of the plurality of cylinders. Method 500 then ends.

If at 504 the VDE mode conditions are met, method 500 proceeds to 508. At 508, method 500 includes determining the cylinders to be selectively deactivated. In one example, the controller may select a portion of the plurality of cylinders to deactivate based on the power draw. The selection may be based on, for example, a previously deactivated portion of the plurality of cylinders during a previous engine start or engine operation in VDE mode. For example, if during the previous engine start, a first group of cylinders on a first engine bank (e.g., first bank 15*a* of FIG. 2) were deactivated, the controller may select the first group of cylinders to deactivate (e.g., to reproduce a previous condition), or the controller may select a second group of cylinders on a second engine bank (e.g., second bank 15*b* of FIG. 2) for deactivation during the present engine start in VDE mode (e.g., to balance a firing of engine cylinders over time). In another example, the controller may select one cylinder or a group of cylinders to deactivate based on one or more sensor readings of the cylinder or group of cylinders. For example, if dual HEGO sensor readings indicated that the first engine bank is rich relative to the second engine bank, the cylinders of the first engine bank (e.g., cylinders 2, 4, 6, 8, as labeled in FIG. 2) may be selected for deactivation. In another example, cylinders may be selected for deactivation based on a temperature of the cylinders, for example, to activate hot cylinders rather than cold cylinders to reduce emissions. In still another example, specific cylinders may be deactivated in accordance with hardware of the engine. For example, when the engine is a V-8 engine, the hardware may selectively activate two specific cylinders from each of the first and second engine banks (e.g., cylinders 4 and 6 from first bank 15*a*, and cylinders 1 and 7 from second bank 15*b*).

At 510, method 500 includes starting the engine with the selected cylinders deactivated. The selected cylinders may be deactivated by disabling respective fuel injectors and disabling respective sparking of the selected cylinders. In some examples, the intake and exhaust valves of the deactivated cylinders may be held closed. The intake and exhaust valves may be closed, for example, via a cam profile switching mechanism in which a cam with no lift is used or by actuating a valve deactivator (e.g., a VDE actuator), as described further with respect to FIG. 1. In other examples, the intake and exhaust valves of the deactivated cylinders may be actuated, but due to the lack of fuel and spark ignition, the deactivated cylinders may pass intake air to the exhaust. Because this may result in a lean exhaust gas being passed to the emission control devices, the intake and exhaust valves may be actuated only during cranking, at least in some examples, which may lower the energy relied on for cranking. Once the engine has been started, the engine may operate with the selected cylinders deactivated.

At 511, power is supplied to the one or more electrical devices via the onboard generator. Once the engine is started and reaches a threshold speed or load (e.g., a speed or load at which sufficient electricity may be generated to power the one or more electrical devices), power may be supplied to the one or more electrical devices. As explained previously, during the engine start and in some examples following the engine start, the supply of current to the electrical device(s) may be suppressed in order to avoid engine stall while the engine is being started. Once the engine reaches a threshold speed or load, the current may be supplied to the electrical device(s).

At 512, method 500 includes adjusting engine operating parameters in order to maintain engine torque. For example, an opening of an intake throttle (e.g., throttle 62 of FIGS. 1 and 2) may be increased in order to increase airflow to the active cylinders and thereby maintain torque during VDE mode. Further, a timing of a spark of a spark plug may be adjusted in the active cylinders. For example, the spark may initially be retarded to minimize torque disturbances during the transition to VDE mode and then restored. Further still, valve timings may be adjusted in the active cylinders. For example, cam timing in the active cylinders may be modified, with camshafts positioned to achieve a desired cylinder air charge for delivering a demanded torque. Depending on demanded torque, in one example, exhaust cams may be retarded to allow exhaust residuals within active cylinders. In another example, intake cams may be advanced to enable increased volumetric efficiency in active cylinders. As such, the above adjustments may enable a desired airflow to maintain a desired engine torque.

At 514, method 500 includes determining whether any additional engine loads are demanded. The additional engine load may be unrelated to the onbaord generator (e.g., vehicle-related electrical loads or an indication that the operator wants to transition to a mobile mode where the vehicle will be propelled by the engine), or the additional engine load may be a result of an increased electrical load of the electrical device(s) (e.g., an operator switching the electrical device into a different mode of operation or plugging in an additional electrical device). For example, while the external electrical device is being powered by the onboard generator, the driver may enter the cabin of the vehicle and activate one or more controls of the vehicle, such as adjusting a temperature of the cabin by switching on heating or air conditioning controls of the vehicle, or the driver may turn on a radio of the vehicle. Further, the driver may enter the vehicle with the laptop and initiate operation of the vehicle while the laptop is being charged by the onboard generator, incurring additional electrical loads in addition to the increased engine load to propel the vehicle.

If it is determined at 514 that one or more additional engine loads have not been demanded, method 500 proceeds to 516. At 516, method 500 includes determining whether to switch off the engine. For example, the driver may complete a task with the electrical device and unplug the electrical device from the power outlet, thereby concluding the power draw. Upon conclusion of the power draw, the power may no longer be supplied by the onboard generator, whereby the controller may determine that engine operation may be discontinued. In another example, the controller may switch the engine off prior to the driver unplugging the electrical device from the power outlet. For example, the controller may receive a request to terminate the stationary power supply mode, or the controller may determine based on a signal from a sensor of the fuel system that a fuel level is not sufficient to continue powering the onboard generator. If it is determined at 516 to switch off the engine, method 500 proceeds to 518. At 518, method 500 includes switching the engine off.

In one example, switching the engine off includes terminating the power supplied by the onboard generator, whereby power is no longer made available at the power outlet of the vehicle. In other examples (e.g., if the vehicle is a hybrid vehicle), switching the engine off may include terminating the power supplied by the onboard generator and supplying power at the power outlet of the vehicle via a battery of the vehicle. Prior to switching the engine off and/or discontinuing to supply power at the power outlet, an audio and/or visual notification may be displayed or played to the driver (e.g., via a message displayed on a screen of a dashboard of the vehicle, or a message or tone played via a speaker of the vehicle, or a visual indication displayed at the power outlet, etc.)

If it is determined at 514 that one or more additional engine loads have been demanded, method 500 proceeds to 520. At 520, method 500 includes reactivating fueling and spark to at least some of the deactivated cylinders. For example, an increased power demand from the electrical device may result in a subset of the deactivated cylinders being reactivated while a request to operate the vehicle in a mobile mode where the engine is used to propel the vehicle may result in all the deactivated cylinders being reactivated. To reactive the deactivated cylinders, the intake and exhaust valves of the deactivated cylinders may be reactivated, for example, via the cam profile switching mechanism or by deactivating the valve deactivator, to allow fresh charge air to enter the cylinders and exhaust to exit the cylinders. Thereby, combustion resumes in some or all of the cylinders that were deactivated during VDE mode.

At 522, method 500 includes adjusting engine operating parameters to maintain engine torque. For example, the opening of the intake throttle may be adjusted to match the airflow to the cylinder demand for combustion. At the same time, spark timing may be retarded to maintain a constant torque on all the cylinders, thereby reducing cylinder torque disturbances. When sufficient airflow is reestablished, spark timing may be restored. In addition to throttle and spark timing adjustments, valve timing may be adjusted at 522 to compensate for torque disturbances. Cam timings may be modified to deliver desired air charges to the cylinder(s) to provide demanded torque. In one example, if cylinder air charge is lighter, exhaust cam timing may be advanced to reduce residuals and ensure a more complete combustion. In another example, if a higher torque is demanded, intake cams may be fully advanced and exhaust cams may be retarded to provide lower dilution and increased power.

In this way, a number of engine cylinders that is less than a total number of engine cylinders of the VDE may be selectively activated on engine startup to produce a torque that is sufficient to cover an estimated power draw of an electrical device plugged into an onboard generator, without activating additional engine cylinders, thereby reducing an emissions of the vehicle and increasing a fuel efficiency of the VDE. The power draw may be estimated from power data transmitted to the controller wirelessly or from a QR code via the rear-end camera of the vehicle. An additional advantage of the method disclosed herein is that the controller may predict the estimated power draw of the electrical device from historical usage patterns of the onboard generator stored in a memory of the controller or on a remote server. A further advantage is that a number of available usage hours of the electrical device may be estimated and notified to the driver.

The technical effect of selectively activating and/or deactivating one or more cylinders of a VDE at an engine startup to cover an estimated power draw of an electrical device plugged into an onboard generator is that an amount of emissions produced by the VDE may be reduced and a fuel efficiency of the VDE may be increased.

The disclosure also provides support for a method for a vehicle, comprising, with an engine of the vehicle turned off, estimating a power draw of an electrical device to be supplied power via an onboard generator of the vehicle, and starting the engine in a variable displacement engine (VDE) mode with a number of deactivated cylinders selected based on the estimated power draw. In a first example of the method, the electrical device is plugged into an AC power outlet coupled to the onboard generator of the vehicle. In a second example of the method, optionally including the first example, estimating the power draw includes receiving power data of the electrical device and estimating the power draw of the electrical device based on the power data. In a third example of the method, optionally including one or both of the first and second examples, receiving the power data of the electrical device includes receiving the power data of the electrical device via a wireless connection between the electrical device and a controller of the vehicle. In a fourth example of the method, optionally including one or more or each of the first through third examples, receiving the power data of the electrical device includes receiving power data of the electrical device transmitted to the controller by a radio frequency identification tag (RFID) tag of the electrical device. In a fifth example of the method, optionally including one or more or each of the first through fourth examples, receiving the power data of the electrical device includes capturing an image of one of a bar code and a QR code of the electrical device via a rear-end camera of the vehicle and estimating the power draw based on power data associated with the bar code or the QR code. In a sixth example of the method, optionally including one or more or each of the first through fifth examples, estimating the power draw includes estimating the power draw based on a historical usage pattern of the onboard generator. In a seventh example of the method, optionally including one or more or each of the first through sixth examples, starting the engine includes starting the engine while a transmission of the vehicle is in a locked mode. In an eighth example of the method, optionally including one or more or each of the first through seventh examples, starting the engine in the VDE mode includes starting the engine with a first, higher number of cylinders deactivated in response to the estimated power draw being a first, lower power draw and starting the engine with a second, lower number of cylinders deactivated in response to the estimated power draw being a second, higher power draw.

The disclosure also provides support for a system for controlling an engine of a vehicle, comprising a controller with computer readable instructions stored on non-transitory memory that when executed during operation of the vehicle, cause the controller to estimate a power draw of an electrical device plugged into an onboard generator of the vehicle, and in a first condition, start the engine with all cylinders of the engine activated, and in a second condition, estimate a minimum number of cylinders of the engine to activate to generate sufficient power to cover the power draw, and start the engine with the minimum number of cylinders of the engine activated, and any cylinders in excess of the minimum number of cylinders deactivated. In a first example of the system, in the second condition, the controller includes further instructions to deactivate each cylinder in excess of the minimum number of cylinders by disabling at least one of a fuel injector of the cylinder, an intake valve of the cylinder, an exhaust valve of the cylinder, and a spark plug of the cylinder. In a second example of the system, optionally including the first example, in the second condition, the controller includes further instructions to, while starting the engine, suppress at least one of an output of the onboard generator of the vehicle and an in-cabin electrical load of the vehicle. In a third example of the system, optionally including one or both of the first and second examples, the controller includes further instructions to stop suppressing the at least one of the output of an onboard generator of the vehicle and the in-cabin electrical load in response to the engine reaching a threshold speed and/or in response to a user input. In a fourth example of the system, optionally including one or more or each of the first through third examples, in the second condition, the controller includes further instructions to, when starting the engine, for each cylinder of the estimated minimum number of cylinders of the engine to activate, retard a spark timing of a spark plug of the cylinder, and advance a timing of opening an exhaust valve of the cylinder to divert heat from a combustion event of the cylinder into an exhaust system of the vehicle prior to a catalyst light-off. In a fifth example of the system, optionally including one or more or each of the first through fourth examples, in the first condition, the power draw of the electrical device is equal to or above a threshold power, the threshold power being an amount of power generated by the onboard generator when all cylinders of the engine are activated, and in the second condition, the power draw of the electrical device is below the threshold power. In a sixth example of the system, optionally including one or more or each of the first through fifth examples, in the first condition, the controller includes further instructions to, in response to the power draw of the electrical device being above a second threshold power, the second threshold power greater than the first threshold power, suppress an output of the onboard generator until a temperature of the VDE reaches a threshold temperature and/or a speed of the engine reaches a threshold speed.

The disclosure also provides support for a method for controlling an engine of a vehicle, comprising, while the engine is off and responsive to a request to start the engine, estimating a power draw of an electrical device plugged into an onboard generator of the vehicle, and responsive to the estimated power draw being above a threshold power, starting the engine with each cylinder of a plurality of cylinders of the engine activated, and responsive to the estimated power draw being below the threshold power, starting the engine with one or more cylinders of the plurality of cylinders of the engine deactivated. In a first example of the method, starting the engine with one or more cylinders of the plurality of cylinders being deactivated includes activating a number of cylinders of the plurality of cylinders to generate sufficient power to cover the estimated power draw, and not activating a greater number of cylinders. In a second example of the method, optionally including the first example, starting the engine with one or more cylinders of the plurality of cylinders being deactivated comprises retarding timing and/or advancing exhaust valve opening timing of one or more activated cylinders of the plurality of cylinders. In a third example of the method, optionally including one or both of the first and second examples, estimating the power draw includes at least one of estimating the power draw from power data of the electrical device transmitted to a controller of the vehicle via a wireless connection, estimating the power draw from power data of the electrical device transmitted to a controller of the vehicle via an image of a QR code of the electrical device captured by a rear-end camera of the vehicle, and predicting the power draw based on a historical usage pattern of the onboard generator.

Note that the example control and estimation routines included herein can be used with various engine and/or vehicle system configurations. The control methods and routines disclosed herein may be stored as executable instructions in non-transitory memory and may be carried out by the control system including the controller in combination with the various sensors, actuators, and other engine hardware. The specific routines described herein may represent one or more of any number of processing strategies such as event-driven, interrupt-driven, multi-tasking, multi-threading, and the like. As such, various actions, operations, and/or functions illustrated may be performed in the sequence illustrated, in parallel, or in some cases omitted. Likewise, the order of processing is not necessarily required to achieve the features and advantages of the example embodiments described herein, but is provided for ease of illustration and description. One or more of the illustrated actions, operations, and/or functions may be repeatedly performed depending on the particular strategy being used. Further, the described actions, operations, and/or functions may graphically represent code to be programmed into non-transitory memory of the computer readable storage medium in the engine control system, where the described actions are carried out by executing the instructions in a system including the various engine hardware components in combination with the electronic controller.

In another representation, a method for a vehicle includes estimating a power draw of an electrical device to be supplied power via an onboard generator of the vehicle; and starting an engine of the vehicle with only a subset of cylinders of the engine active, where a number of cylinders included in the subset of cylinders is selected based on the estimated power draw. In a first example of the method, the method includes determining that the estimated power draw is a first, higher power draw, and in response, starting the engine with a first, lower number of cylinders active. In a second example of the method, optionally including the first example, the method includes determining that the estimated power draw is a second, lower power draw, and in response, starting the engine with a second, higher number of cylinders active. In a third example of the method, optionally including one or both of the first and second examples, starting the engine of the vehicle with only the subset of cylinders of the engine active comprises starting the engine with at least one cylinder deactivated. In a fourth example of the method, optionally including one or more or each of the first through third examples, the power draw is estimated based on power data communicated wirelessly from the electrical device to the vehicle. In a fifth example of the method, optionally including one or more or each of the first through fourth examples, the power draw is estimated based on historical power usage data obtained by the vehicle. In a sixth example of the method, optionally including one or more or each of the first through fifth examples, the vehicle is a hybrid vehicle including an electric motor configured to propel the vehicle, and wherein starting the engine comprises starting the engine while the vehicle is propelled by the electric motor.

It will be appreciated that the configurations and routines disclosed herein are exemplary in nature, and that these specific embodiments are not to be considered in a limiting sense, because numerous variations are possible. For example, the above technology can be applied to V-6, I-4, I-6, V-12, opposed 4, and other engine types. Moreover, unless explicitly stated to the contrary, the terms "first," "second," "third," and the like are not intended to denote any order, position, quantity, or importance, but rather are used merely as labels to distinguish one element from another. The subject matter of the present disclosure includes all novel and non-obvious combinations and sub-combinations of the various systems and configurations, and other features, functions, and/or properties disclosed herein.

As used herein, the term "approximately" is construed to mean plus or minus five percent of the range unless otherwise specified.

The following claims particularly point out certain combinations and sub-combinations regarded as novel and non-obvious. These claims may refer to "an" element or "a first" element or the equivalent thereof. Such claims should be understood to include incorporation of one or more such elements, neither requiring nor excluding two or more such elements. Other combinations and sub-combinations of the disclosed features, functions, elements, and/or properties may be claimed through amendment of the present claims or through presentation of new claims in this or a related application. Such claims, whether broader, narrower, equal, or different in scope to the original claims, also are regarded as included within the subject matter of the present disclosure.

The invention claimed is:

1. A method for a vehicle, comprising:

with an engine of the vehicle turned off:

estimating a power draw of an electrical device to be supplied power via an onboard generator of the vehicle; and starting the engine in a variable displacement engine (VDE) mode with a number of deactivated cylinders selected based on the estimated power draw.

2. The method of claim 1, wherein the electrical device is plugged into an alternating current (AC) power outlet coupled to the onboard generator of the vehicle.

3. The method of claim 1, wherein estimating the power draw includes receiving power data of the electrical device and estimating the power draw of the electrical device based on the power data.

4. The method of claim 3, wherein receiving the power data of the electrical device includes receiving the power data of the electrical device via a wireless connection between the electrical device and a controller of the vehicle.

5. The method of claim 4, wherein receiving the power data of the electrical device includes receiving power data of the electrical device transmitted to the controller by a radio frequency identification tag (RFID) tag of the electrical device.

6. The method of claim 3, wherein receiving the power data of the electrical device includes capturing an image of one of a bar code and a QR code of the electrical device via a rear-end camera of the vehicle and estimating the power draw based on power data associated with the bar code or the QR code.

7. The method of claim 1, wherein estimating the power draw includes estimating the power draw based on a historical usage pattern of the onboard generator.

8. The method of claim 1, wherein starting the engine includes starting the engine while a transmission of the vehicle is in a locked mode.

9. The method of claim 1, wherein starting the engine in the VDE mode includes starting the engine with a first, higher number of cylinders deactivated in response to the estimated power draw being a first, lower power draw and starting the engine with a second, lower number of cylinders deactivated in response to the estimated power draw being a second, higher power draw.

10. A system for controlling an engine of a vehicle, comprising:

a controller with computer readable instructions stored on non-transitory memory that when executed during operation of the vehicle, cause the controller to:

estimate a power draw of an electrical device plugged into an onboard generator of the vehicle;

in a first condition, start the engine with all cylinders of the engine activated; and in a second condition:

estimate a minimum number of cylinders of the engine to activate to generate sufficient power to cover the power draw; and start the engine with the minimum number of cylinders of the engine activated, and any cylinders in excess of the minimum number of cylinders deactivated.

11. The system of claim 10, wherein in the second condition, the controller includes further instructions to deactivate each cylinder in excess of the minimum number of cylinders by disabling at least one of:

a fuel injector of the cylinder;

an intake valve of the cylinder;

an exhaust valve of the cylinder; and a spark plug of the cylinder.

12. The system of claim 10, wherein in the second condition, the controller includes further instructions to:

while starting the engine, suppress at least one of:

an output of the onboard generator of the vehicle; and an in-cabin electrical load of the vehicle.

13. The system of claim 12, wherein the controller includes further instructions to stop suppressing the at least one of the output of an onboard generator of the vehicle and the in-cabin electrical load in response to the engine reaching a threshold speed and/or in response to a user input.

14. The system of claim 10, wherein in the second condition, the controller includes further instructions to:

when starting the engine, for each cylinder of the estimated minimum number of cylinders of the engine to activate:

retard a spark timing of a spark plug of the cylinder; and advance a timing of opening an exhaust valve of the cylinder to divert heat from a combustion event of the cylinder into an exhaust system of the vehicle prior to a catalyst light-off.

15. The system of claim 10, wherein in the first condition, the power draw of the electrical device is equal to or above a threshold power, the threshold power being an amount of power generated by the onboard generator when all cylinders of the engine are activated; and in the second condition, the power draw of the electrical device is below the threshold power.

16. The system of claim 15, wherein in the first condition, the controller includes further instructions to:

in response to the power draw of the electrical device being above a second threshold power, the second threshold power greater than the first threshold power, suppress an output of the onboard generator until a temperature of the VDE reaches a threshold temperature and/or a speed of the engine reaches a threshold speed.

17. A method for controlling an engine of a vehicle, comprising:

while the engine is off and responsive to a request to start the engine, estimating a power draw of an electrical device plugged into an onboard generator of the vehicle;

responsive to the estimated power draw being above a threshold power, starting the engine with each cylinder of a plurality of cylinders of the engine activated; and responsive to the estimated power draw being below the threshold power, starting the engine with one or more cylinders of the plurality of cylinders of the engine deactivated.

18. The method of claim 17, wherein starting the engine with one or more cylinders of the plurality of cylinders being deactivated includes activating a number of cylinders of the plurality of cylinders to generate sufficient power to cover the estimated power draw, and not activating a greater number of cylinders.

19. The method of claim 18, wherein starting the engine with one or more cylinders of the plurality of cylinders being deactivated comprises retarding timing and/or advancing exhaust valve opening timing of one or more activated cylinders of the plurality of cylinders.

20. The method of claim 17, wherein estimating the power draw includes at least one of:

estimating the power draw from power data of the electrical device transmitted to a controller of the vehicle via a wireless connection;

estimating the power draw from power data of the electrical device transmitted to a controller of the vehicle via an image of a QR code of the electrical device captured by a rear-end camera of the vehicle; and predicting the power draw based on a historical usage pattern of the onboard generator.

* * * * *